US006412895B1

(12) United States Patent
Takemoto et al.

(10) Patent No.: US 6,412,895 B1
(45) Date of Patent: Jul. 2, 2002

(54) ELECTROSTATIC INK JET PRINTER

(75) Inventors: Hitoshi Takemoto; Tadashi Mizoguchi; Junichi Suetsugu; Hitoshi Minemoto; Kazuo Shima; Yoshihiro Hagiwara; Toru Yakushiji, all of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/177,753

(22) Filed: Oct. 23, 1998

(30) Foreign Application Priority Data

Oct. 23, 1997 (JP) ..... 9-291258
Feb. 5, 1998 (JP) ..... 10-024234

(51) Int. Cl.[7] ..... B41J 29/38
(52) U.S. Cl. ..... 347/10; 347/55
(58) Field of Search ..... 347/15, 10, 11, 347/12, 55

(56) References Cited

U.S. PATENT DOCUMENTS

| | | | | |
|---|---|---|---|---|
| 4,737,860 A | * | 4/1988 | Ono et al. | 358/298 |
| 5,038,158 A | * | 8/1991 | Ayers et al. | 347/55 |
| 5,530,464 A | * | 6/1996 | Hiwada | 347/55 |
| 5,619,234 A | * | 4/1997 | Nagato et al. | 347/55 |
| 6,123,415 A | * | 9/2000 | Nagato et al. | 347/55 |

FOREIGN PATENT DOCUMENTS

| | | |
|---|---|---|
| EP | 0208322 | 1/1987 |
| EP | 0758584 | 2/1997 |
| JP | 61108259 | 5/1986 |
| JP | 61184051 | 8/1986 |
| JP | 61-293863 | 12/1986 |
| JP | 62280053 | 12/1987 |
| JP | 2-198855 | 8/1990 |
| JP | 2274555 | 11/1990 |
| JP | 3-234636 | 10/1991 |
| JP | 3-277553 | 12/1991 |
| JP | 4201354 | 7/1992 |
| JP | 4-316851 | 11/1992 |
| JP | 6-155766 | 6/1994 |
| JP | 8-174868 | 7/1996 |
| JP | 8-276572 | 10/1996 |
| JP | 8-290587 | 11/1996 |
| JP | 9-85953 | 3/1997 |
| JP | 9-85954 | 3/1997 |
| JP | 10226073 | 8/1998 |

* cited by examiner

*Primary Examiner*—John Barlow
*Assistant Examiner*—Julian D. Huffman
(74) *Attorney, Agent, or Firm*—Ostrolenk, Faber, Gerb & Soffen, LLP

(57) ABSTRACT

An ink jet printer has a plurality of ink ejection electrodes for receiving an ejecting voltage to eject an ink droplet, a pulse width generator for specifying the pulse width of each ejecting electrode to obtain a dot diameter of the ink droplet for gray-scale printing. The ejecting voltage Vej for each ejection electrode is divided into a plurality of unit pulses. Each unit pulse is supplied to a corresponding ejection electrode concurrently with unit pulses for other ejection electrodes. A combination of unit pulses for a single ejection electrode forms a single ink droplet having a dot diameter corresponding to the number of unit pulses, thereby achieving accurate gray-scale printing with a reduced circuit scale.

8 Claims, 10 Drawing Sheets

ELECTROSTATIC INK JET PRINTER

BACKGROUND OF THE INVENTION (a) Field of the Invention

The present invention relates to an electrostatic ink jet printer and, more particularly, to a head drive unit in an electrostatic ink jet printer, which controls the dot diameter of an ink droplet made of colored particles ejected from pigment ink.

(b) Description of the Related Art

Electrostatic ink jet printers are increasingly used for a personal computer due to its high printing performance as well as small noise. A printing head and a head drive unit in a conventional electrostatic ink jet printer will be described first with reference to FIGS. 1 to 4.

FIG. 1 is a perspective view of a printing head 100 in the conventional ink jet printer, FIG. 2 is a schematic block diagram of the printing head 100 of FIG. 1 and an associated head drive unit 200, FIG. 3 is a timing chart of signals applied to an electrophoretic electrode and an ejection electrode in the printing head 100, and FIG. 4 is a timing chart of ejecting pulses having an ejecting voltage Vej and supplied to ejection electrodes for recording different dot diameters.

In FIG. 1, the printing head 100 includes an ink chamber 102 receiving therein pigment ink 101 and having an ink ejection slit 104 at the front edge thereof, a plurality of ejection electrodes 106 extending in parallel to one another from the rear edge to the front edge of the printing head 100, an electrophoretic electrode 103 disposed at the rear edge of the ink chamber 102 for driving colored particles in the pigment ink 101 toward the ink ejecting slit 104 for concentration of the colored particles at the ink ejecting slit 104, and a counter electrode 107 disposed on the back surface of a recording sheet 105 to oppose the front tips of the ejection electrodes 106.

The ink ejecting slit 104 is partitioned by passage walls 108 corresponding to respective ejection electrodes 106 to generate an ink meniscus of pigment ink on each ejection electrode 106. The ink chamber 102 is communicated with an ink reservoir (not shown) at an ink inlet port 109 and an ink outlet port 110 through ink tubes. Thus, a back pressure is applied to the pigment ink in the ink chamber 102, and the pigment ink 101 in the ink chamber 102 is forced to circulate between the ink chamber 102 and the ink reservoir.

The head drive unit 200, as shown in FIG. 2, has an image data control section 205 for receiving gray-scale image data from a processor, a driver control section 203 for generating switching signals for controlling switches in a driver section 202 based on the image data, a pulse width generator 204 for generating pulse width signals based on the image data, and the driver section 202 including a plurality of switches each for receiving the switching signal from the driver control section 203 to apply an ejecting voltage Vej to a corresponding ejection electrode 106 during a time interval based on the pulse width signals.

In operation, the printing head 100 uses an electrophoretic phenomenon wherein colored particles in the pigment ink 101 are driven in a direction specified by an electric field applied to the pigment ink 101 containing electrified colored particles. More specifically, when a constant electrophoretic voltage V1 shown in FIG. 3 is applied to the electrophoretic electrode 103 to generate an electric field in the ink chamber 102 filled with the pigment ink 101, colored particles in the pigment ink 101 move toward the ink ejecting slit 104 at an electrophoretic speed.

After the colored particles move toward the ink ejecting slit 104, an ink meniscus 206 is form at the tip of each ejection electrode 106. When a switch in the driver section 202 shown in FIG. 2 is turned on, an ejecting pulse having a constant voltage Vej and a duty ratio of 50 to 100%, as shown in FIG. 3, is applied to a corresponding ejection electrode 106. Thus, colored particles are driven by the electrostatic field generated between the ejection electrode 106 and the counter electrode 107, and ejected from the ink ejecting slit 104 against the surface tension of the ink meniscus 206 and the viscous force of the pigment ink 101. The colored particles are ejected as ink droplets 201 from the tip of the ejection electrode 106 in synchrony with the ejecting pulse $P_{EJ}$ to adhere onto the recording sheet 105 as a dot. The colored particles are replenished from the ink reservoir to be iteratively ejected to form an image on the recording sheet 105.

A conventional technique for forming a desired dot diameter based on the level of the gray-scale data will be now described.

For obtaining a desired dot diameter of the ink droplet 201, correlation between the dot diameter and the pulse width of the ejecting pulse such as shown in FIG. 3 is experimentally determined and the list of the pulse widths is stored in combination with the level of the gray-scale image data in a storage device or a memory. The image data control section 205 receives gray-scale image data from the processor, retrieves a pulse width corresponding to the level of the gray-scale image data in the storage device, and transmits the pulse width data to the pulse width generator 204. The image data control section 205 also transmits the image data for controlling on/off of the switch in the driver section 202 to the driver control unit 203. The pulse width generator 204, after receiving the pulse width data, generates a pulse width signal based on each gray-scale level of the ejection electrodes 106 to supply ejecting voltage Vej. Thus, the driver control section 203 closes the switches in the driver section 202 during time intervals based on the respective gray-scale image data to thereby apply the ejecting voltage Vej to the ejection electrodes 106.

In the example of FIG. 4, it is assumed that forty ejection electrodes 106-1 to 106-40 are provided in the ink jet printer and are applied with the depicted ejecting pulses. If the ejection electrodes 106-1, 106-2, 106-3 and 106-40 are desired to form dot diameters of 20 $\mu$m, 50 $\mu$m, 75 $\mu$m, and 100 $\mu$m, respectively, ejecting pulses $P_{EJ}$ having pulse widths of 50 $\mu$s, 80 $\mu$s, 90 $\mu$s and 100 $\mu$s are applied to the ejection electrodes 106-1, 106-2, 106-3 and 106-40, respectively. The respective pulse widths provide desired dot diameters of the ink droplets based on the gray-scale image data, thereby forming desired image data on the recording sheet 105.

The conventional ink jet recording device as described above has a disadvantage in that the circuit scale of the pulse width generator 204 increases with the increase of the number of ejection electrodes 106 provided and the number of gray-scale levels supplied.

In addition, when a plurality of ejection electrodes 106 have variations of the electric resistance therealong, the dot diameters formed by the respective ejection electrodes 106 depend on the variations of the electric resistance, thereby degrading the printing quality for the gray-scale level.

SUMMARY OF THE INVENTION

It is therefore an object of the present invention to provide an ink jet printer including a head drive unit having a simpler structure of the pulse width generator even if the number of ejection electrodes and the numbers of gray-scale levels increase.

It is another object of the present invention to provide a uniform dot diameter without depending on variations of the electric resistance of the ejection electrodes.

The present invention provides an ink jet printer comprising a printing head including an ink chamber for receiving therein pigment ink, the ink chamber having an ink jet slit, and an array of ink ejection electrodes, disposed in the ink chamber, for receiving an ejecting voltage to eject the pigment ink from the ink jet slit, and a head drive unit for receiving a set of recording data for the ejection electrodes during each recording clock cycle to generate a plurality of sets of first data during each recording clock cycle based on the recording data, each set of the first data including a bit data for each of the ejection electrodes, a combination of the bit data for each of the ejection electrodes in each recording clock cycle specifying a pulse width of the ejecting voltage for the each of the ejection electrodes.

In accordance with the ink jet printer of the present invention, head control section can provide a pulse width of the ejecting voltage for each ejection electrode based on the combination of bit data, thereby generating the pulse width data with a simple structure. Further, a pulse width can be selected to cancel the variations of electric resistance of ejection electrodes.

The above and other objects, features and advantages of the present invention will be more apparent from the following description, referring to the accompanying drawings.

PREFERRED EMBODIMENTS OF THE INVENTION

Figure 1:
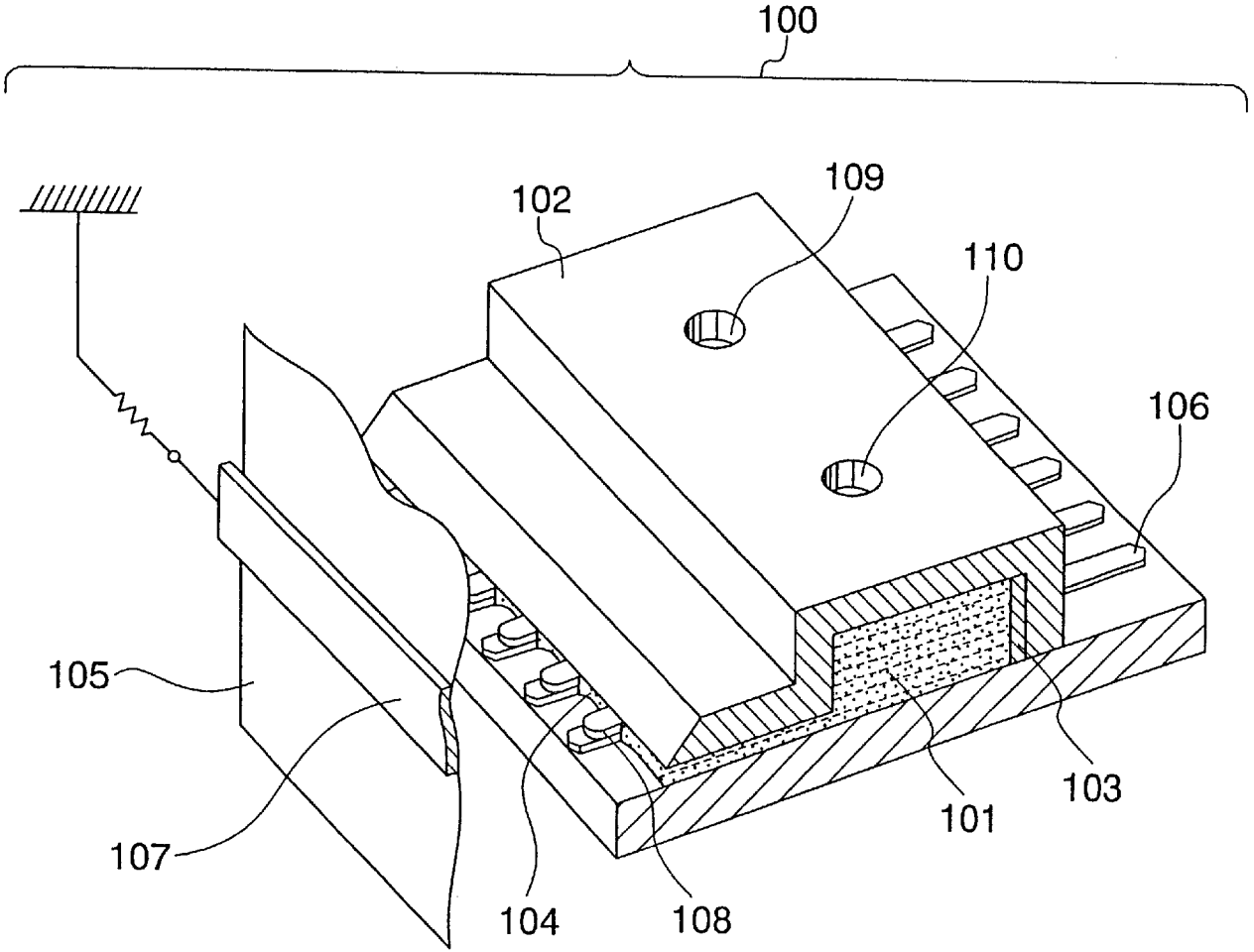
FIG. 1 PRIOR ART
FIG. 1 is a perspective view of a printing head in a conventional electrostatic ink jet printer.
Figure 2:
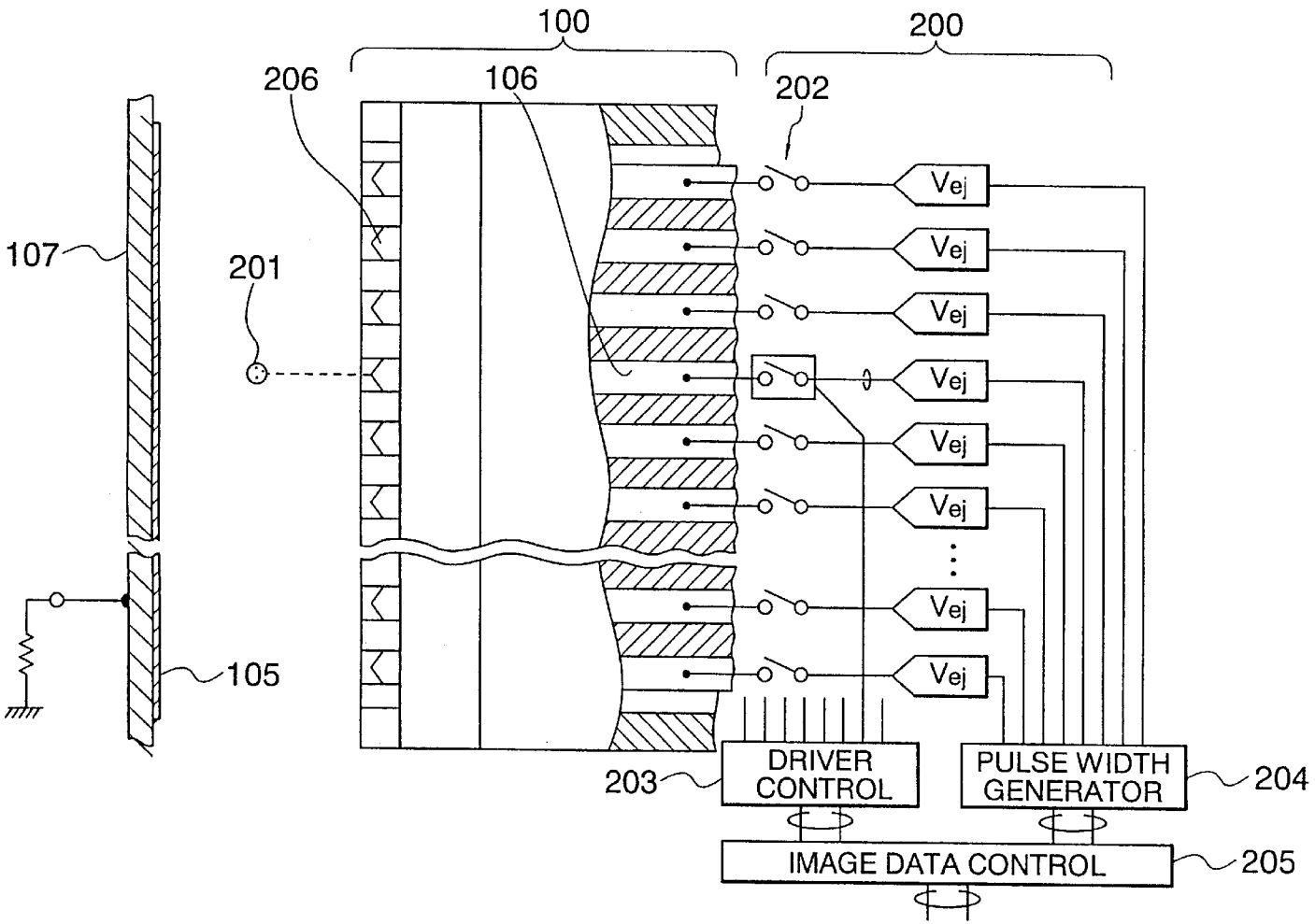
FIG. 2 PRIOR ART
FIG. 2 is a schematic block diagram of the printing head of FIG. 1 and an associated head drive unit.
Figure 3:
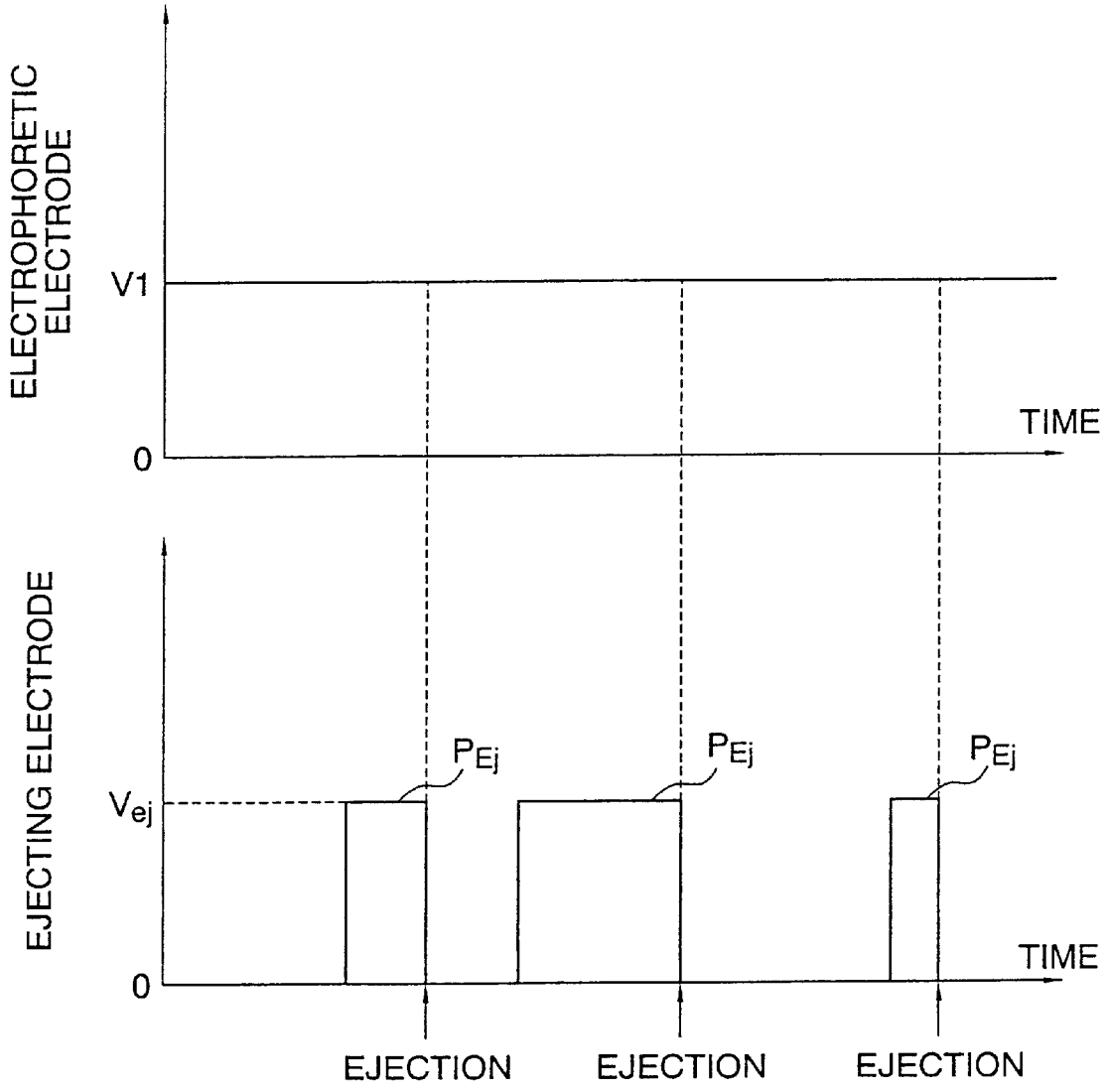
FIG. 3 PRIOR ART
FIG. 3 is a signal timing chart of electrophoretic voltage and ejecting pulses in the conventional ink jet printer of FIG. 1.
Figure 4:
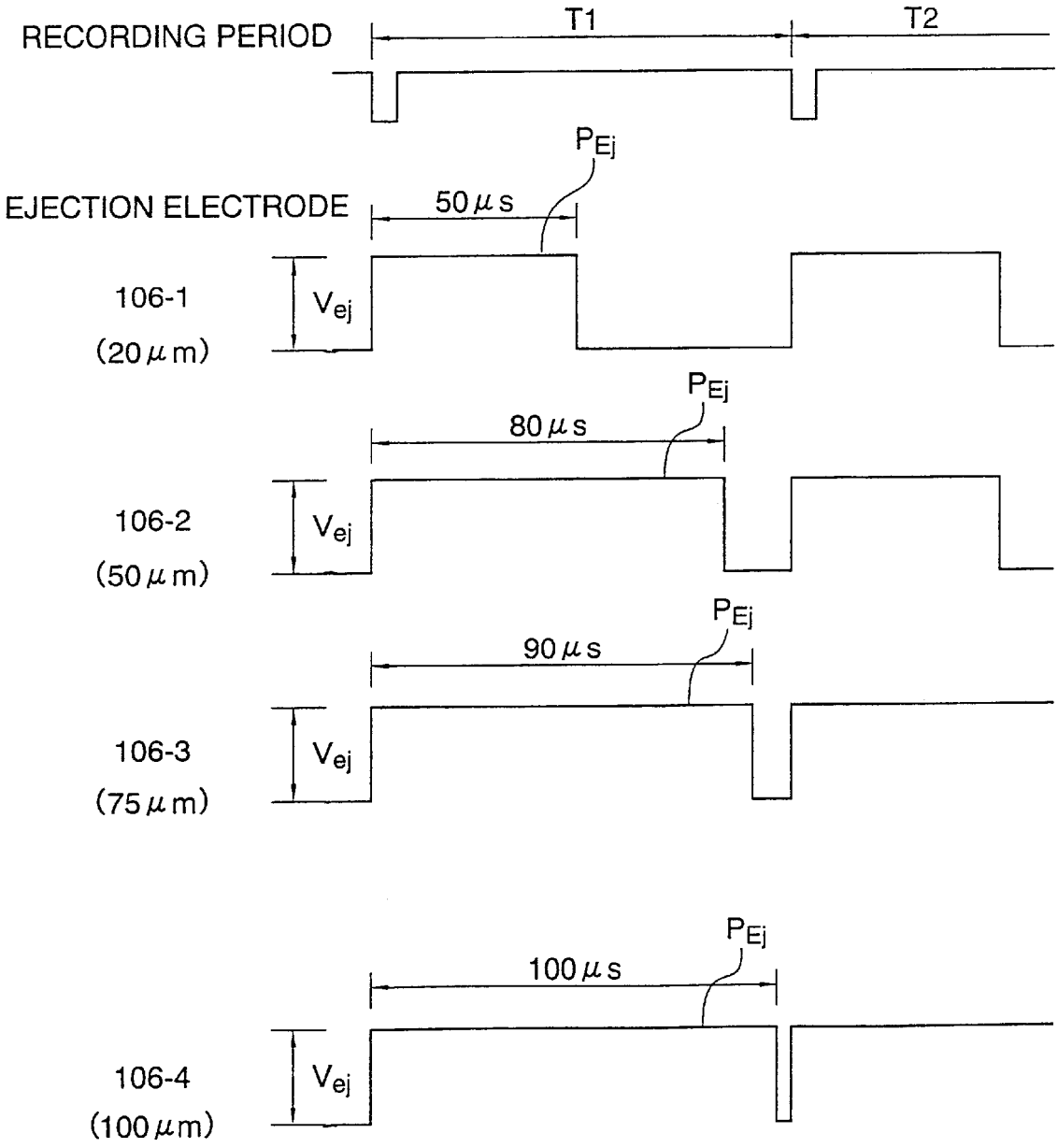
FIG. 4 PRIOR ART
FIG. 4 is a signal timing chart of ejecting pulses based on gray-scale data in the conventional ink jet printer of FIG. 1.

Now, the present invention is more specifically described based on preferred embodiments thereof with reference to the accompanying drawings. A printing head in an ink jet printer according to an embodiment of the present invention has a structure similar to that described with reference to FIGS. 1 and 2.

Specifically, the printing head 100 in the ink jet printer of the present embodiment includes an ink chamber 102 receiving therein pigment ink 101 and having an ink ejection slit 104 at the front edge thereof, a plurality of ejection electrodes 106 extending in parallel to one another from the rear edge to the front edge of the printing head 100, an electrophoretic electrode 103 disposed at the rear edge of the ink chamber 102 for driving colored particles in the pigment ink 101 toward the ink ejecting slit 104 for concentration of the colored particles at the ink ejecting slit 104, and a counter electrode 107 disposed on the back surface of a recording sheet 105 to oppose the front tips of the ejection electrodes 106.

The ink ejecting slit 104 is partitioned by passage walls 108 corresponding to respective ejection electrodes 106 to generate an ink meniscus 206 of pigment ink on each ejection electrode 106. The ink chamber 102 is communicated with an ink reservoir (not shown) at an ink inlet port 109 and an ink outlet port 110 through ink tubes. Thus, a back pressure is applied to the pigment ink in the ink chamber 102, and the pigment ink 101 in the ink chamber 102 is forced to circulate between the ink chamber 102 and the ink reservoir.

Figure 5:
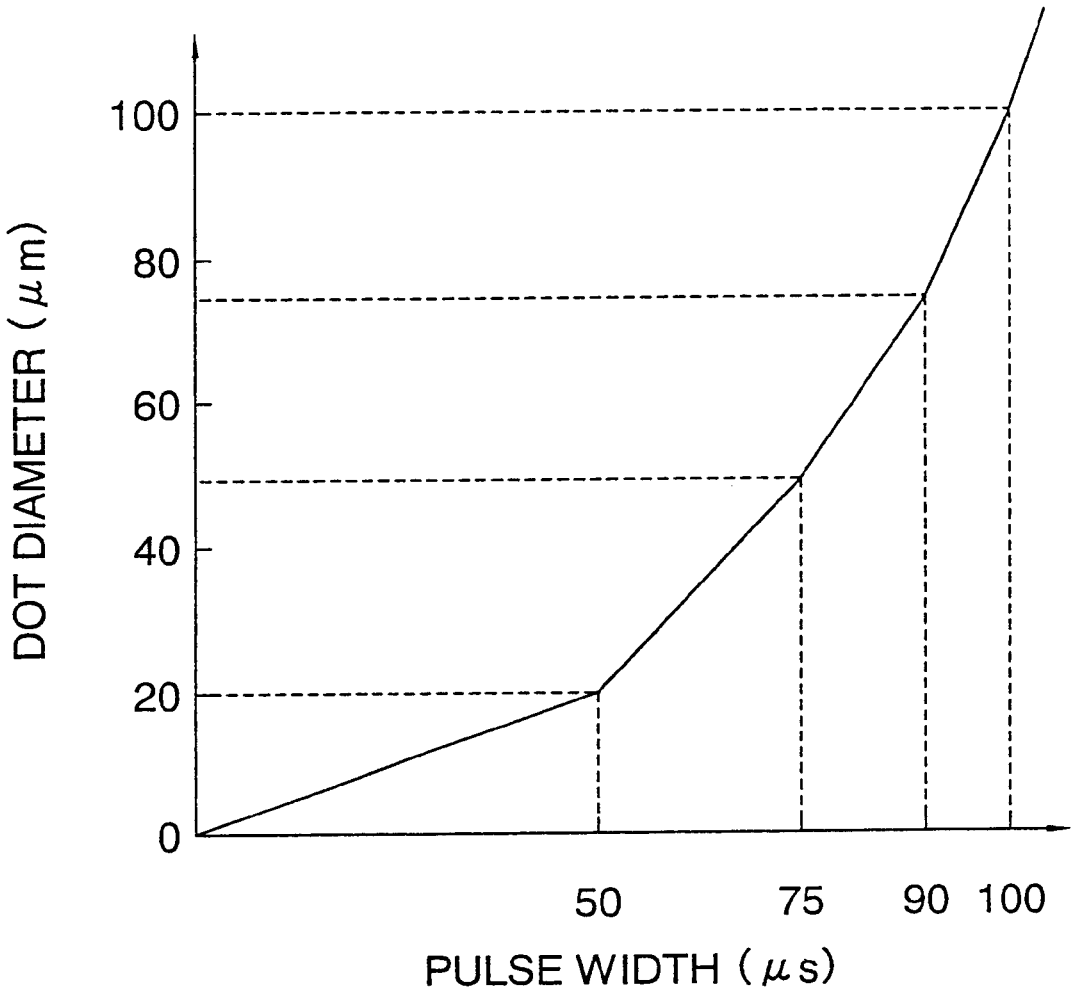
FIG. 5 is a graph showing the relationship between the pulse width applied to an ejection electrode and the dot diameter made therefrom.

Referring to FIG. 5, there is shown a graph showing an exemplified relationship between the pulse width ($\mu$s) applied to an ejection electrode 106 and the dot diameter ($\mu$m) of the ink droplet obtained therefrom for effecting gray-scale printing. Specifically, if an ejection electrode 106 is applied with ejecting pulses having pulse widths of 50 $\mu$s, 75 $\mu$s, 90 $\mu$s and 100 $\mu$s in the example, the ejection electrode 106 forms ink droplets having diameters of 20 $\mu$m, 50 $\mu$m, 75 $\mu$m and 100 $\mu$m, respectively. This is experimentally determined in the ink jet printer of the present embodiment. Each pulse width for the ejection electrode 106 is obtained by a plurality of straight unit pulses each having a unit period, as detailed below.

Figure 6:
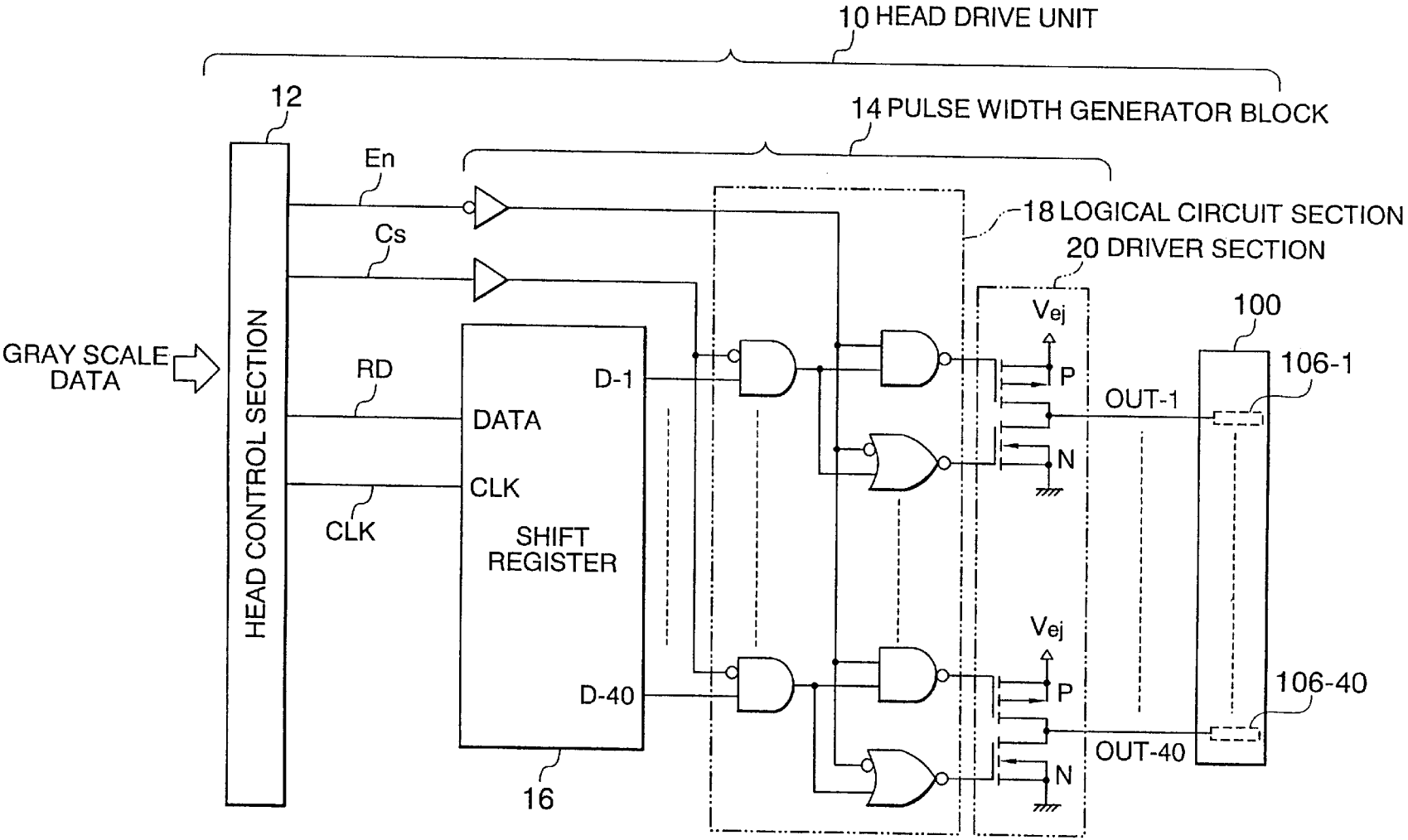
FIG. 6 is a logical circuit diagram of a head drive unit in an electrostatic ink jet printer according to an embodiment of the present invention.

Referring to FIG. 6, a head drive unit 10 in the ink jet printer according to the present embodiment is used to drive forty ejection electrodes 106-1 to 106-40 mounted on the printing head 100. The head drive unit 10 includes a head control section 12 for receiving gray-scale data from a processor to generate internal signals En, Cs, RD and CLK, and a pulse width generator block 14 for generating respective ejecting pulses Out-1 to Out-40 for the ejection electrodes 106-1 to 106-40. The pulse width generator block 14 includes a shift register 16 for receiving serial recording data RD and a clock signal CLK of the internal signals from the head control section 12, a logical circuit section 18 for receiving an enable signal En and a control signal Cs of the internal signals from the head control section 12 and parallel data from the shift register 16, and a drive section 20 including forty switching transistors each receiving a corresponding drive signal from the logical circuit section 20 to apply an ejecting pulse having an ejecting voltage Vej to a corresponding one of the ejection electrodes 106-1 to 106-40.

The head drive unit 10 applies ejecting pulses Out-1 to Out-40 to the ejection electrodes 106-1 to 106-40, respectively, which generate an electric field in the ink chamber 102, thereby ejecting ink droplets 201 from the ink ejecting slit 104 at once due to the Coulomb force acting on the colored particles. The ejected ink droplets 201 have different dot diameters depending on the pulse widths, and adhere to a recording sheet to form a gray-scale image.

The head control section 12 converts therein the gray-scale data of each ejection electrode into a plurality of unit pulses, the number of which corresponds to the pulse width, which is obtained from desired dot diameter with reference to FIG. 5. More specifically, after a set of gray-scale image data specifying a pulse width for each ejection electrode is transmitted from a processor, the head control section 12 determines the number of unit pulses to be supplied to each ejection electrode based on the specified pulse width corresponding to the dot diameter. For example, if the pulse widths are 50 μs, 80 μs, 90 μs and 100 μs for ejection electrodes 106-1, 106-2, 106-3 and 106-40, respectively, the numbers of unit pulses supplied are 5, 8, 9 and 10, respectively. Thus, the head control section 12 delivers "1" for each ejection electrode during the counted number of unit pulses for each recording period T1.

The head control section 12 supplies each unit pulse for the ejection electrodes 106-1 to 106-40 through the pulse width generator block 14 by determining the presence or absence of the unit pulse for all the ejection electrodes during a single divided recording period. The unit pulse has a fixed period T that is equal to T1/11, T1 corresponding to a single recording period for obtaining a single ink droplet for each ejection electrode 106. The number of unit pulses applied to an ejection electrode 106 corresponds to the level of the gray-scale data for that ejection electrode 106 supplied from the head control section 12.

In this embodiment, a single recording period T1 for obtaining a dot diameter from each ejection electrode is divided by 11 to obtain a divided recording period T. In each divided recording period T, the gray-scale data for all the forty ejection electrodes are examined in the head control section 12 whether the respective ejection electrodes 106 are to be applied with a unit pulse having the ejecting voltage Vej at each divided recording period T.

The head control section 12 delivers "1" or "0" for each ejection electrode during a single divided recording period T as a serial data. After the data for all the ejection electrodes for a single divided period T is delivered to the shift register 16 together with the clock signal CLK, the shift register 16 passes the data to the logical circuit section 18 as parallel data. The head control section 12 iteratively delivers the serial data for a single divided recording period T during the recording period T1 for applying driving pulses having the specified pulse widths.

During each divided recording period, the logical circuit section 18 transmits driving pulses Out-1 to Out-40 to the ejection electrodes 106-1 to 06-40, respectively, based on the following truth table:

| D-1 to D-40 | Control signal Cs | Enable signal En | Out-1 to Out-40 |
|---|---|---|---|
| H | L | L | H |
| L | L | L | L |
| X | H | L | L (all) |
| X | X | H | Hi-Z (all) |

In the truth table, D-1 to D-40 represent respective data for the ejection electrodes, X represents H or L, and Hi-Z represents a high-impedance state.

Figure 7:
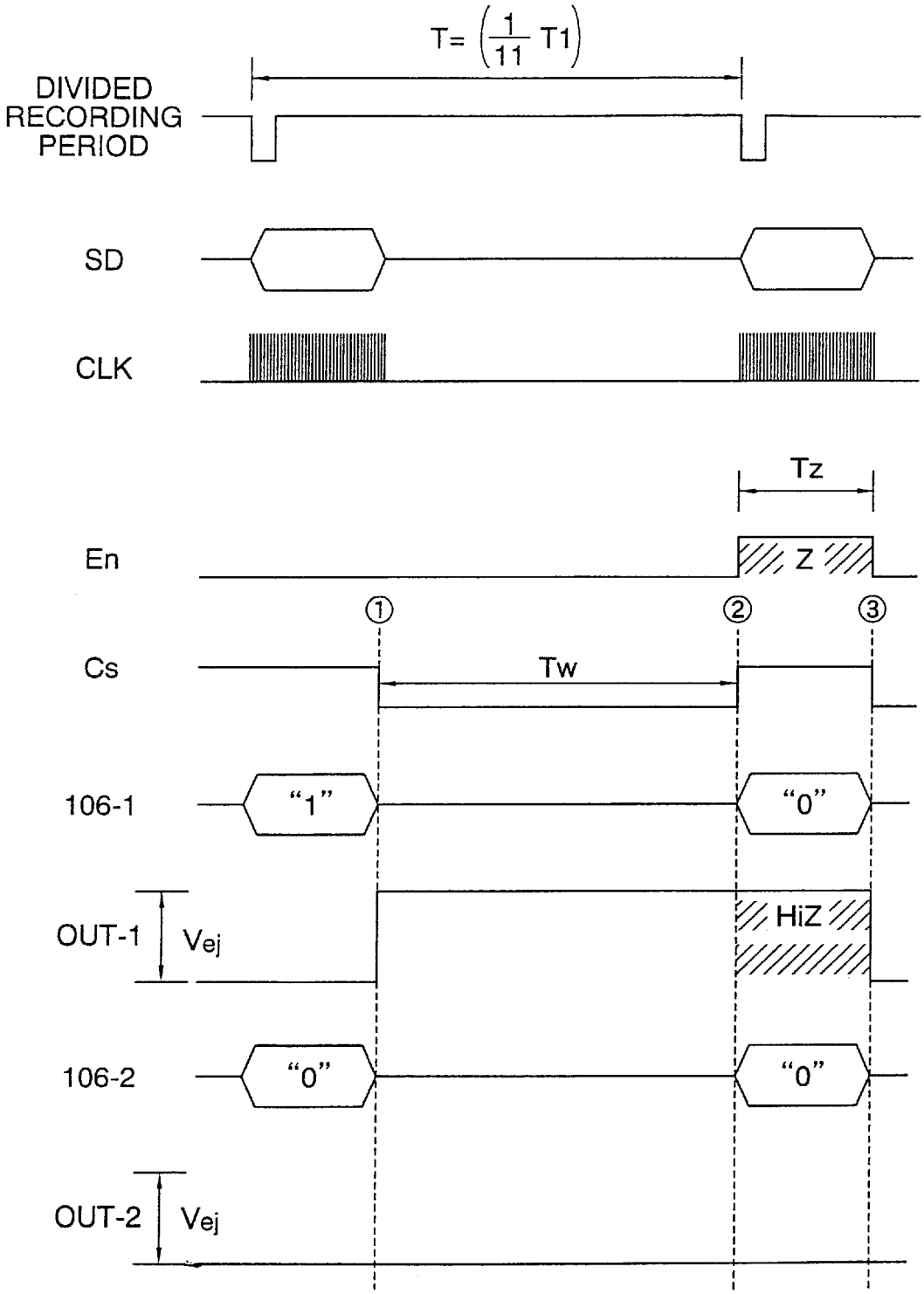
FIG. 7 is a signal timing chart during a divided recording period of the head drive unit of FIG. 6.

Referring to FIG. 7, there is shown exemplified outputs Out-1 and Out-2 delivered to ejection electrodes 106-1 and 106-2, respectively, during a single divided recording period T of a recording period T1 (T=T1/11), wherein ejection electrode 106-1 has data "1" and ejection electrode 106-2 has data "0" in the divided recording period T, followed by a next divided recording period T wherein the ejection electrode 106-1 has data "0". The head control section 12 delivers serial data for forty ejecting electrodes 106-1 to 106-40 at the beginning of the first divided period T of each recording period T1, while maintaining the enable signal En at a low level and the control signal Cs at a high level to maintain the outputs of the driver section 20 at a low level during transmission of the serial data. This prevents erroneous ejection of the ink droplets.

Subsequently, the head control section 12 sets the control signal Cs at a low level during a time period Tw to transmit the data for each ejection electrode through the logical circuit section 18 to each ejection electrode 106 in the first divided period T. Thus, ejection electrode 106-1 is applied with the ejecting voltage Vej whereas ejection electrode 106-2 is not applied with the ejecting voltage Vej in the first divided period T. After applying the ejecting voltage Vej to selected ejection electrodes, such as ejection electrode 106-1 in this example, the printing head shifts into a second divided recording period T. The head control section 12 sets the enable signal En at a high level during a time interval Tz to render all the ejection electrodes 106-1 to 106-40 at a high-impedance state while delivering another set of serial recording data for all the ejection electrodes 106-1 to 106-40. In the high-impedance state, all the ejection electrodes maintain the respective previous data due to the parasitic capacitance of the ejection electrodes 106, wherein ejection electrodes 106-1 and 106-2 maintain a high level and a low level, respectively. The head control section 12 repeats the operation for the divided recording periods T during a single recording period T1 for effecting a pulse width operation based on a set of recording data.

Figure 8:
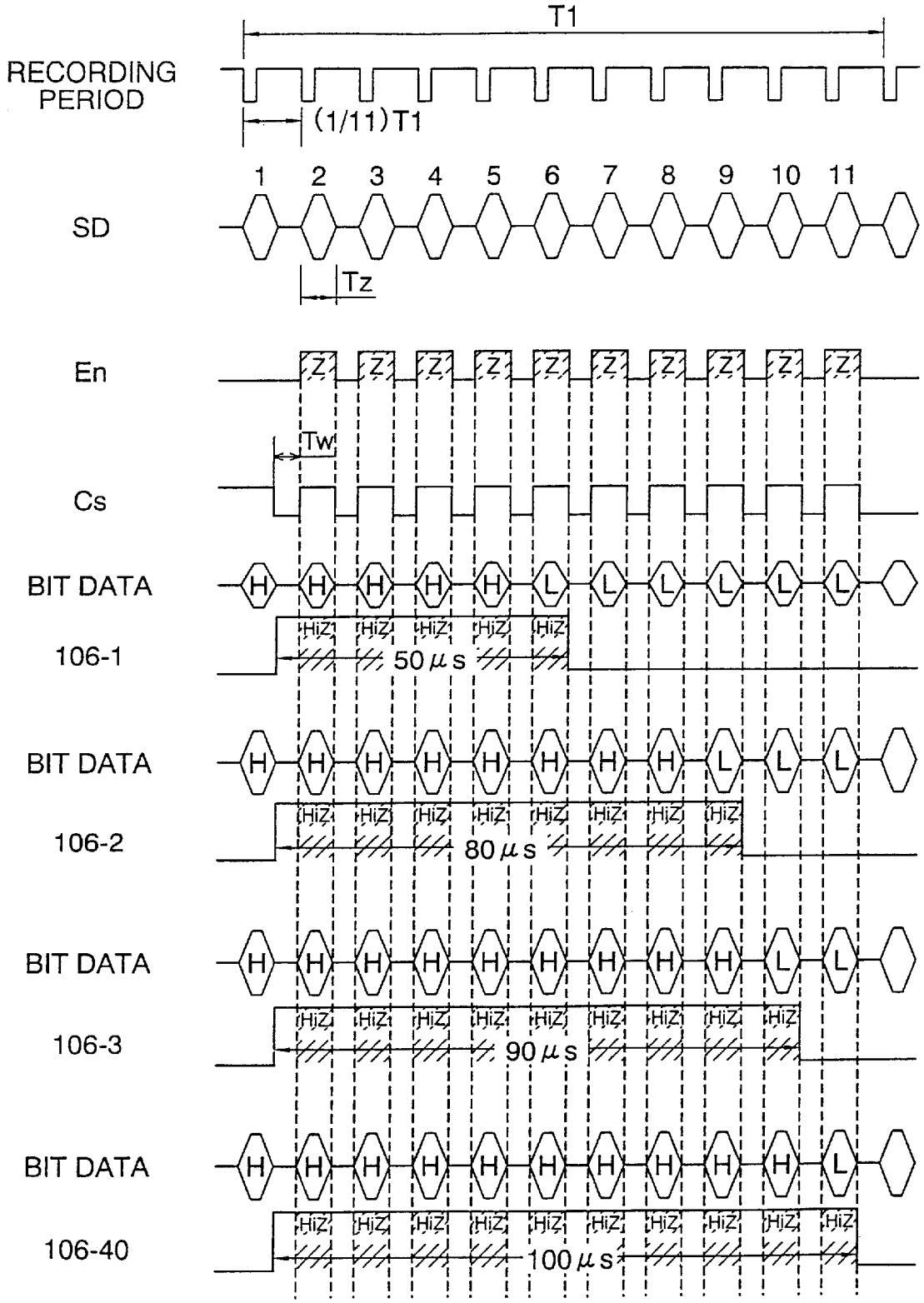
FIG. 8 is a signal timing chart during a single recording period of the head drive unit of FIG. 5.

Referring to FIG. 8, there is shown an exemplified operation of the printing head during a single recording period T1. The recording period T1(=110 μs) is divided by eleven to obtain a divided recording period T(=10 μs), during which each unit pulse is applied to selected ejection electrodes. The divided recording period T includes a signal delivery period Tw effected by a low level of the control signal Cs and a high-impedance period Tz effected by a high level of the enable signal En, as described above. Ejection electrodes 106-1, 106-2, 106-3 and 106-40 are to be maintained at the ejecting voltage Vej during the time intervals 50 μs, 80 μs, 90 μs and 100 μs, which correspond to dot diameters of 20 μm, 50 μm, 75 μm and 100 μm, respectively, based on the data supplied from the processor.

The processor delivers gray-scale data having ten different levels to the head control section 12, which outputs a set of unit-pulse pulse (or bit data) for each of the ejection electrodes during the ten divided recording periods. In the example, the head control section 12 sets five straight on-states of ejection electrode 106-1 to supply the ejecting voltage Vej for 50 μs, thereby allowing ejection electrode 106-1 to eject an ink droplet having a diameter of 20 μm. The head control section sets eight straight on-states of ejection electrode 106-2 to supply the ejecting voltage Vej for 80 μs, thereby allowing ejection electrode 106-2 to eject an ink droplet having a diameter of 50 μm.

Similarly, ejection electrodes 106-3 an 106-40 are applied with the ejecting voltage for 90 μs and 100 μs, respectively, to eject ink droplets having diameters of 75 μm and 100 μm, respectively. After ten divided recording cycles, a single dummy data cycle is effected wherein a high level of the control signal Cs is supplied so as to set all the ejection electrodes 106 at a low level, e.g., ground. The dummy data period separates two consecutive ink droplets ejected from a single ejection electrode, especially when the number of unit pulses is at a maximum (ten), as is the illustrated case of ejection electrode 106-40.

Figure 9:
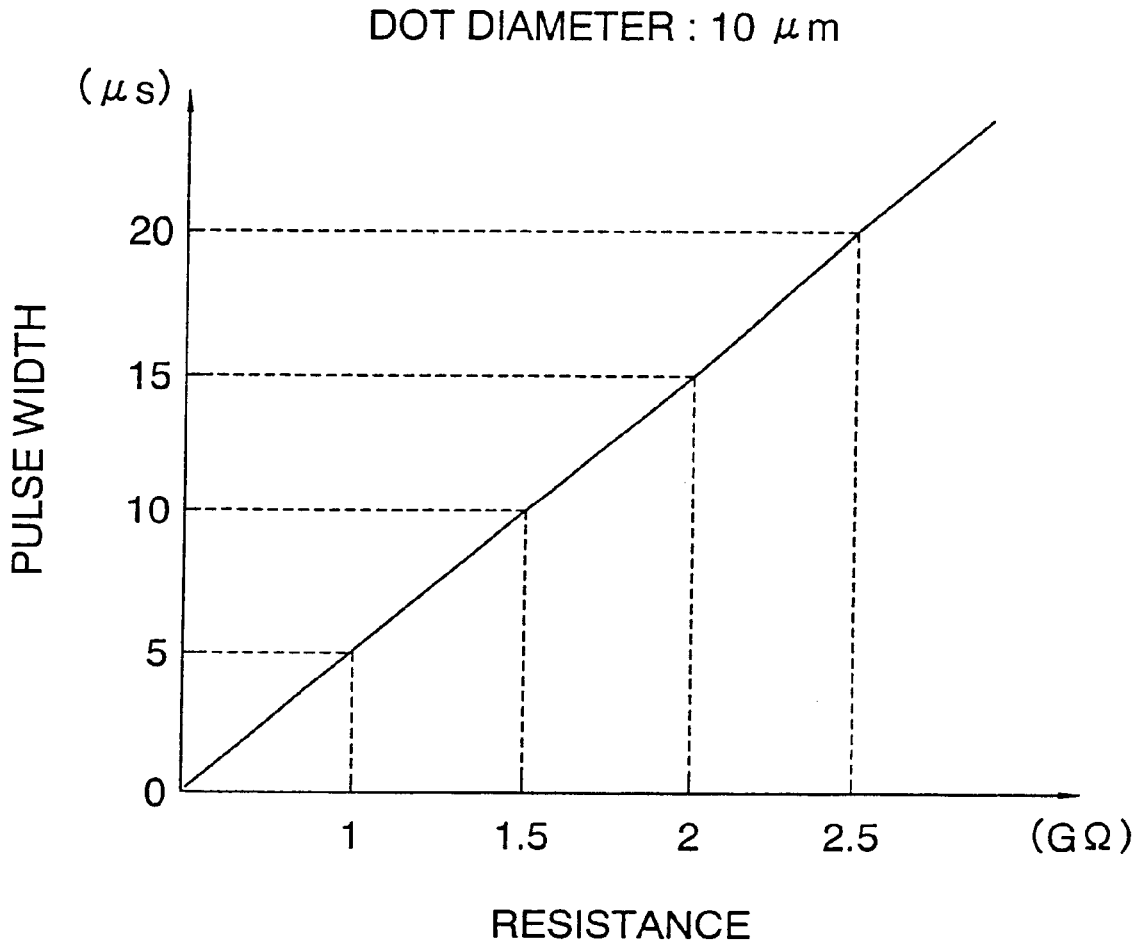
FIG. 9 is a graph for showing the relationship between the pulse width and the electric resistance of the ejection electrode for obtaining a specified dot diameter.

Referring to FIG. 9, there is shown an adverse affect of the variations of the electric resistance of the ejection electrode, wherein the relationship between the pulse width and the electric resistance of an ejection electrode therealong is illustrated when a dot diameter of 10 μm is to be obtained. An ink jet printer according to a second embodiment of the present invention is directed to correction of the pulse width based on the graph to obtain a uniform dot diameter by compensating the variations of the electric resistance of the ejection electrodes. As shown in FIG. 9, an ejection electrode having resistances of 1, 1.5, 2 and 2.5 GΩ should be applied with ejecting pulses having pulse widths corresponding to 5, 10, 15 and 20 unit pulses in number, respectively, to obtain a 10 μm dot diameter. The relationship between the electric resistance and the pulse width such as shown in FIG. 9 is obtained by measurement and stored in the head control section 12 for each dot diameter in the ink jet printer.

Figure 10:
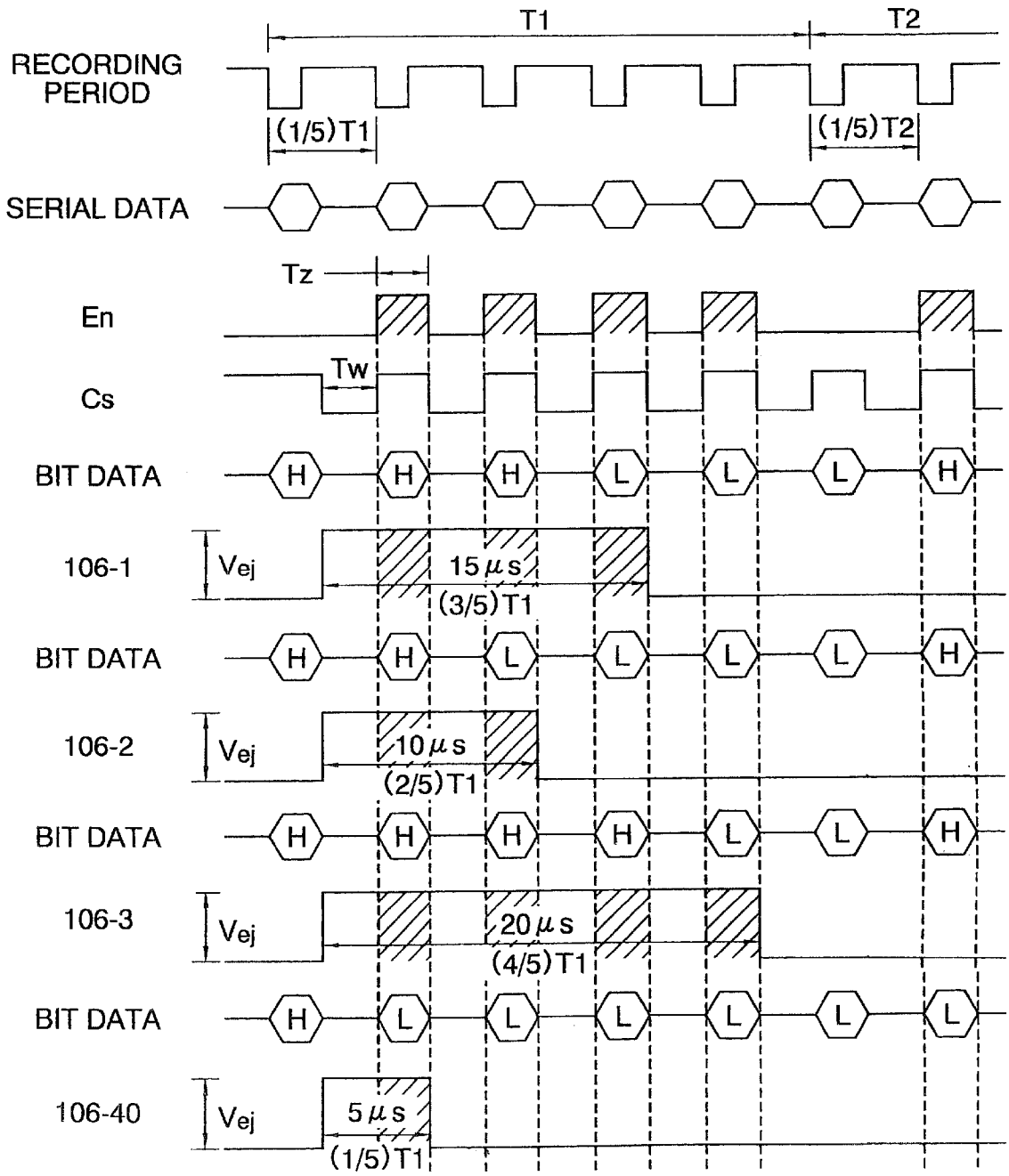
FIG. 10 is a signal timing chart in an ink jet printer according to a second embodiment of the present invention.

Referring to FIG. 10, there is shown a signal timing chart of a head drive unit in the ink jet printer of the present embodiment, the configuration itself of which is similar to that of the first embodiment described with reference to FIG. 5. In the present embodiment, the recording period T1 (or T2) for obtaining a single ink droplet is divided into five divided recording periods T in consideration of the variations of the electric resistance of the ejection electrodes.

To correct the pulse width based on the graph of FIG. 9, it is noted that the variations of the resistance reside within 1.0 and 2.5 GΩ and corresponding pulse widths reside between 5 and 20 μs. In this example, the unit pulse width or divided recording period T is determined at 5 μs for a recording period T1 of 25 μs, to compensate the variations of electric resistance by a 5 μs step.

If ejection electrodes 106-1, 106-2, 106-3 and 106-40 have electric resistances of 2 GΩ, 1.5 GΩ, 2.5 GΩ and 1 GΩ, respectively, the head control section 12 stores data of 15 μs, 10 μs, 20 μs and 5 μs for ejection electrodes 106-1, 106-2, 106-3 and 106-40, respectively, for a 10 μm dot diameter.

In FIG. 10, there is shown an exemplified operation of the printing head of the present embodiment for obtaining a 10 μm dot diameter. The recording period T1(=25 μs) is divided by five to obtain a divided recording period T(=5 μs), during which each unit pulse is applied to a selected ejection electrode. The divided recording period T includes Tw for a low level of the control signal Cs and Tz for a high level of the enable signal En, such as described with reference to the first embodiment. Ejection electrodes 106-1, 106-2, 106-3 and 106-40 are maintained at the ejecting voltage Vej during time intervals of 15 μs, 10 μs, 20 μs and 5 μs, all of which correspond to the dot diameter of 10 μm, based on the graph of FIG. 9.

The head control section 12 outputs unit-pulse based data during the five divided recording periods T. In the example of FIG. 10, the head control section 12 sets three straight on-states of ejection electrode 106-1 to supply the ejecting voltage Vej for 15 μs, thereby allowing ejection electrode 106-1 to eject an ink droplet having a diameter of 10 μm. The head control section sets two straight on-states of ejection electrode 106-2 to supply the ejecting voltage Vej for 10 μs, thereby allowing ejection electrode 106-2 to eject an ink droplet having a diameter of 10 μm. Similarly, ejection electrodes 106-3 and 106-40 are applied with the ejecting voltage for 20 μs and 5 μs, respectively, to eject ink droplets having a diameter of 10 μm.

After the five divided recording periods, a single dummy data period is effected, wherein a high level of the control signal Cs is supplied to set all the ejection electrodes at a low level. The dummy data separates two consecutive ink droplets ejected from a single ejection electrode, especially when the number of unit pulses is at a maximum.

Since the above embodiments are described only for examples, the present invention is not limited to the above embodiments and various modifications or alterations can be easily made therefrom by those skilled in the art without departing from the scope of the present invention.

What is claimed is:

1. An ink jet printer comprising a printing head including an ink chamber for receiving therein pigment ink, said ink chamber having an ink jet slit, and an array of ink jet electrodes, disposed in said ink chamber, for receiving an ejecting voltage to eject said pigment ink from said inkjet slit, and a head drive unit for receiving a set of recording data for said ejection electrodes during each recording clock cycle to generate a plurality of sets of first data during each recording clock cycle based on said set of recording data, each set of said first data including bit data for each of said ejection electrodes, a combination of said bit data for each of said ejection electrodes in each said recording clock cycle specifying an effective pulse width of said ejecting voltage for said each of said ejection electrodes, wherein said head drive unit includes a head control section for outputting a plurality of sets of serial data during each said recording clock cycle based on said set of recording data, and a shift register for serial/parallel conversion of said serial data into said first data and said head control section outputs a dummy data in each recording clock cycle to separate ink droplets ejected in adjacent recording clock cycles from each said ejection electrode.

2. The ink jet printer as defined in claim 1, wherein said head drive unit includes a logic section for maintaining said bit data of one set of first data while said head control section output another set of first data.

3. The ink jet printer as defined in claim 2, wherein said head control section outputs an enable signal to said logic circuit, for setting all of said ejection electrodes at a high state and a control signal for setting all of said ejection electrodes at a low state.

4. An ink jet printer comprising a printing head including an ink chamber for receiving therein pigment ink, said ink chamber having an ink jet slit, and an array of ink jet electrodes, disposed in said ink chamber, for receiving an ejecting voltage to eject said pigment ink from said inkjet slit, and a head drive unit for receiving a set of recording data for said ejection electrodes during each recording clock cycle to generate a plurality of sets of first data during each recording clock cycle based on said set of recording data, each set of said first data including bit data for each of said ejection electrodes, a combination of said bit data for each of said ejection electrodes in each said recording clock cycle specifying an effective pulse width of said ejecting voltage for said each of said ejection electrodes, wherein said head control section outputs a dummy data in each recording clock cycle to separate ink droplets ejected in adjacent recording clock cycles from each said ejection electrode.

5. The ink jet printer as defined in claim 4, wherein said head drive unit includes a pulse width generator for receiving said first data to output a second data representing said combination of bit data.

6. The ink jet printer as defined in claim 4, wherein selection of said effective pulse width compensates for variations of electric resistance of said ejection electrodes.

7. The ink jet printer as defined in claim 4, wherein specification of said pulse width determines a dot diameter of said ink droplet.

8. The ink jet printer as defined in claim 4, wherein said recording data is gray-scale data.

* * * * *